US006958673B2

(12) United States Patent
Suzuki

(10) Patent No.: US 6,958,673 B2
(45) Date of Patent: Oct. 25, 2005

(54) COIL BOBBIN WITH CORE SPACING MECHANISMS

(75) Inventor: Mitsuaki Suzuki, Iwata-gun (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 10/614,218

(22) Filed: Jul. 8, 2003

(65) Prior Publication Data

US 2004/0036568 A1 Feb. 26, 2004

(30) Foreign Application Priority Data

Aug. 22, 2002 (JP) ..... 2002-241823

(51) Int. Cl.[7] ..... H01F 27/30
(52) U.S. Cl. ..... 336/208; 336/198
(58) Field of Search ..... 336/208, 198, 336/192

(56) References Cited

U.S. PATENT DOCUMENTS 6,154,113 A * 11/2000 Murai ..... 336/198
6,492,890 B1 * 12/2002 Woznlczka ..... 336/61
6,611,189 B2 * 8/2003 Sigl ..... 336/198
6,853,284 B2 * 2/2005 Nagai et al. ..... 336/83

* cited by examiner

*Primary Examiner*—Anh Mai
(74) *Attorney, Agent, or Firm*—Oliff & Berridge, PLC

(57) ABSTRACT

A coil bobbin comprises a core housing portion which has a magnet wire wound therearound, and which undergoes a varnish impregnation treatment together with a magnetic core consisting of two core sections, like an EE type or UU type. Core spacing mechanisms are formed on the inner surfaces of the core housing portion, and control a position of the magnetic core inserted in the core housing portion such that the magnetic core is kept apart from the inner surfaces of the core housing portion.

10 Claims, 5 Drawing Sheets

COIL BOBBIN WITH CORE SPACING MECHANISMS

BACKGROUND OF THE INVENTION

1. Field of the Invention

The present invention relates to a coil bobbin, and particularly to a coil bobbin which undergoes a varnish impregnation treatment together with a magnetic core.

2. Description of the Related Art

A conventional transformer or choke coil comprises a magnetic core using a ferrite core and a plastic bobbin having a magnet wire wound therearound. The magnetic core consists of two separate sections like EE type, or UU type, where the two separate core sections abut against each other to form a closed magnetic path. In the structure, a gap may grow at the abutting contact portion and acts as a critical factor determining magnetic characteristics of the core. The abutting contact condition may be secured by adhesively bonding, taping or by means of a metallic spring.

The transformer or choke coil may undergo a well-known varnish impregnation treatment together with its magnetic core depending on its application. The treatment is to improve insulation performance of its winding section and to enhance stabilities against electrical oscillation and mechanical oscillation. The treatment is usually carried out such that the whole body of the transformer or choke coil except its terminal pins is immersed into a dilute solution of polyester resin, and then, is dried and cured at about 130 degrees C.

The plastic coil bobbin having a magnet wire wound therearound is formed of either a thermoplastic resin or a thermosetting resin, which is to be selected according to its application. Since the moisture resistance of the coil bobbin after the varnish impregnation treatment becomes an issue, the bobbin is formed of, for example, a thermoplastic resin with a low water absorption rate (polybutylene terephthalate), which is disclosed in Japanese Patent Publication No. Hei 11-335533.

In the coil bobbin described above, since a predetermined clearance is provided between the inner wall of a core housing portion 1 and a portion 2 (middle bar of an E core section) of a magnetic core 2 inserted in the core housing portion 1, a gap 4 exists inevitably therebetween as shown in FIGS. 6A to 6C showing cross sectional views of a conventional coil bobbin. Consequently, during the varnish impregnation treatment, varnish is allowed to penetrate into the gap 4 as well as the winding section. The cross sectional shape defined by inner wall surfaces of the core housing portion 1 and the cross sectional shape of the portion 2 are similar to each other, usually rectangular, with a slight proportional difference in dimension, and the gap 4 may be generated in three manners as shown in FIGS. 6A to 6C. Specifically, FIG. 6A shows that the portion 2 is not in contact with any of four inner wall surfaces of the core housing portion 1, FIG. 6B shows that the portion 2 has its one side surface brought into contact with one inner wall surface 30, and FIG. 6C shows that the portion 2 has its two adjacent side surfaces brought into contact with two inner wall surfaces 30 and 31. When the varnish is cured, the portion 2 is tightly fixed to the inside wall surface 30 in the case shown by FIG. 6B, and to the inside wall surfaces 30 and 31 in the case shown by FIG. 6C. Consequently, as shown in FIG. 7A, in case of a magnetic core comprising two portions, like an EE type and a UU type, brought into contact with each other at their abutting surface, the two portions 20 and 21 are forced to be tightly fixed to the inside wall surface(s) at either or both of the above-described abutting surfaces 30 and 31.

While the varnish impregnation treatment improves insulation performance of the winding section and also stabilities against electrical oscillation and mechanical oscillation, it creates the following problem. Since the two core sections 20 and 21 are tightly fixed, with varnish 40, to the inner surface of the core housing portion 1 as described above, a dimensional change of the coil bobbin due to changes in the ambient temperature or humidity generates stress at the fixation area causing force to act on an abutting contact surface G between the two core sections 20 and 21 which undergo a smaller dimensional change than the coil bobbin, thereby generating a gap g therebetween as shown in FIG. 7B. The gap g causes a magnetic reluctance to increase, resulting in reduced inductance of the transformer or choke coil.

Therefore, the coil bobbin is preferably formed of a resin material which undergoes least possible dimensional change due to changes in the ambient temperature and humidity. Particularly, to cope with the change due to the ambient humidity, a thermoplastic resin with a low water absorption rate (polybutylene-terephthalate) is preferably used. However, the coil bobbin formed of the thermoplastic resin (polybutylene-terephthalate) is easily deformed or its terminal pins are easily bent due to heat applied when the coil is subjected to soldering work, which causes a quality problem. Further, the soldering work requires a special caution, thereby hindering the working efficiency.

SUMMARY OF THE INVENTION

The present invention has been made in light of the above-described problems, and its object is to provide a coil bobbin formed of a heat resistant plastic resin, for example, phenolic resin, which may surfer a large dimensional change due to the ambient temperature or humidity but is deformed only slightly under heat.

In order to achieve the above-described object, according to a first aspect of the present invention, a coil bobbin comprises a core housing portion which has a magnet wire wound therearound, and which undergoes a varnish impregnation treatment together with a magnetic core consisting of two core sections. Core spacing mechanisms are formed on the inner surfaces of the core housing portion, and control the position of the magnetic core inserted in the core housing portion.

According to a second aspect of the present invention, in the coil bobbin of the first aspect, at least one core spacing mechanism is formed on each of inner wall surfaces of the core housing portion.

According to a third aspect of the present invention, in the coil bobbin of the first or second aspect, each of the spacing mechanisms is formed symmetrically about a plane of a abutting contact surface defined between the two core sections of the magnetic core.

According to a fourth aspect of the present invention, in the coil bobbin of any one of the first to third aspects, the core spacing mechanisms each consist of a linear ridge.

According to a fifth aspect of the present invention, in the coil bobbin of any one of the first to third aspects, the core spacing mechanisms each consist of two separate dot projections.

Consequently, the magnetic core is prevented from getting firmly fixed to the coil bobbin by means of varnish through a varnish impregnation treatment, thus preventing a gap from growing at the abutting contact surface between the two core sections even when the coil bobbin undergoes a dimensional change due to the ambient temperature or humidity change. As a result, magnetic reluctance is prevented from increasing, whereby the inductance of a transformer or choke coil is kept constant.

Further, the material of a coil bobbin is conventionally selected according to its application such that a thermoplastic resin, which suffers a small dimensional change due to the ambient temperature or humidity change (for example, polybutylene-terephthalate), is used when the coil bobbin is preferred to be environment-resistant, and a thermosetting resin (for example, phenol) is used when the coil bobbin is preferred to be heat-resistant, for example, during soldering process. In the present invention, the coil bobbin formed of a thermosetting resin can be environment-resistant as well as heat-resistant, which eliminates the troublesome selection of the coil bobbin material according to its application, and which ensures heat-resistance preventing the coil bobbin from deforming or terminal pins from bending due to the heat from the soldering work and therefore eliminating special caution during the soldering work improving the work efficiency.

BRIEF DESCRIPTION OF THE DRAWINGS

FIGS. 6A to 6C are cross-sectional views (taken in the same manner as FIG. 5) of a conventional coil bobbin and a magnetic core, wherein FIG. 6A shows the magnetic core is not in contact with any of inner wall surfaces of a core housing portion of the coil bobbin, FIG. 6B shows the magnetic core is in contact with one inner surface thereof, and FIG. 6C shows the magnetic core is in contact with two inner wall surfaces thereof, and FIGS. 7A and 7B are explanatory views of a magnetic core tightly attached to an inner wall surface of a core housing portion of a conventional coil bobbin, wherein FIG. 7A shows a state before the coil bobbin expands under heat, and FIG. 7B shows a state after the coil bobbin expands under heat generating a gap at an abutting contact surface between two core sections.

DETAILED DESCRIPTION OF THE PREFFERRED EMBODIMENTS

Preferred embodiments of the present invention will hereinafter be described with reference to the accompanying drawings.

Figure 1:
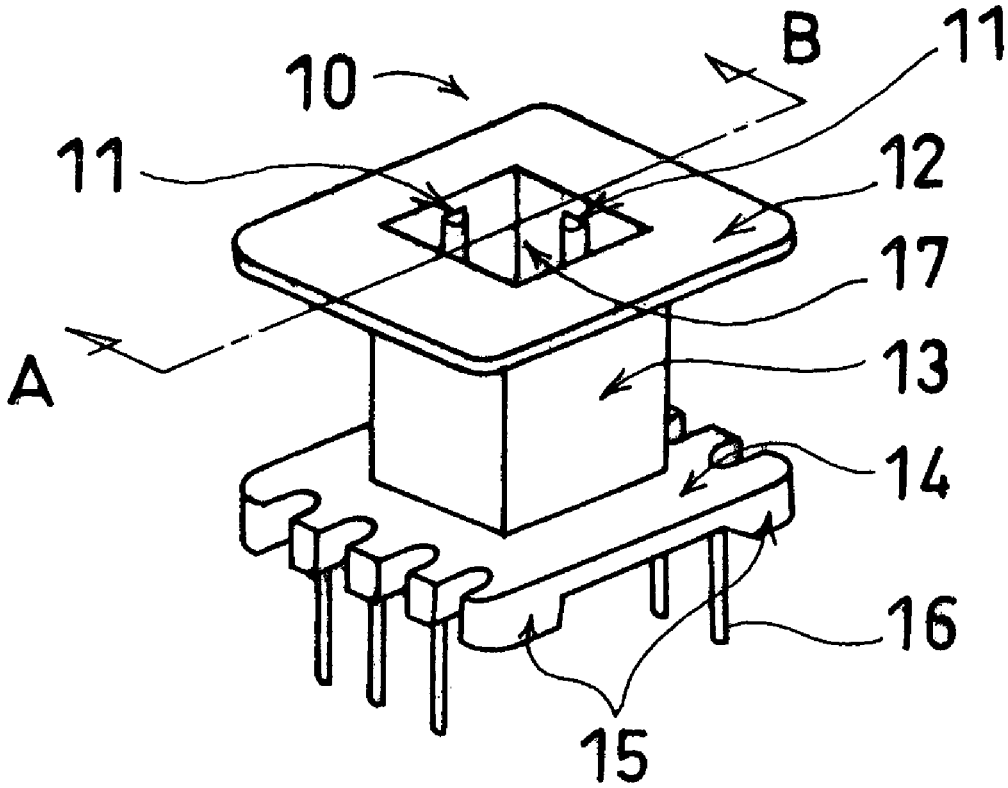
FIG. 1 is perspective view of a coil bobbin according to a first embodiment of the present invention.

Referring to FIG. 1, a coil bobbin 10 comprises a top flange 12, a base flange 14, and a core housing portion 13 formed therebetween. The base flange 14 has terminal pins 16 to which a winding (not shown) is connected, and is provided with coil stand portions 15. The core housing portion 13 is of square tubular structure, has a magnet wire (not shown) wound therearound, and has at least one core spacing mechanism 11 provided on each of four surfaces of its inner wall 17 and formed into a linear ridge extending straight in the direction of inserting the magnetic core.

Figure 2A:
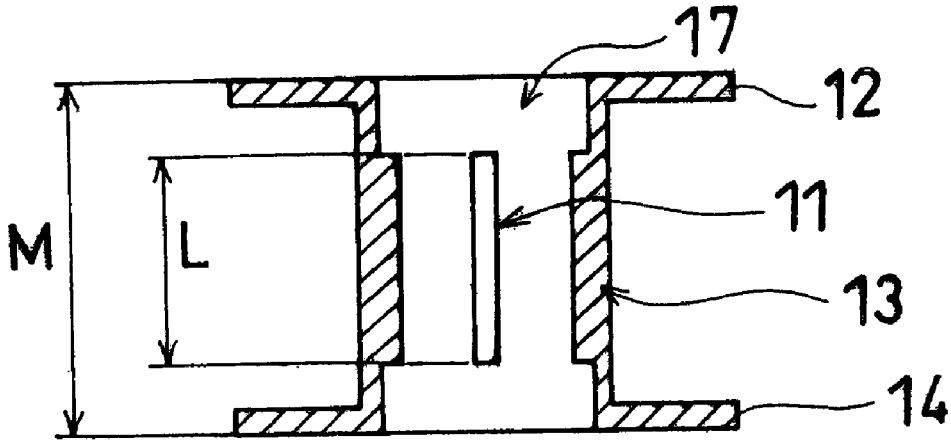
FIG. 2A is a cross-sectional view of the coil bobbin of FIG. 1 taken along a line A-B.
Figure 2B:
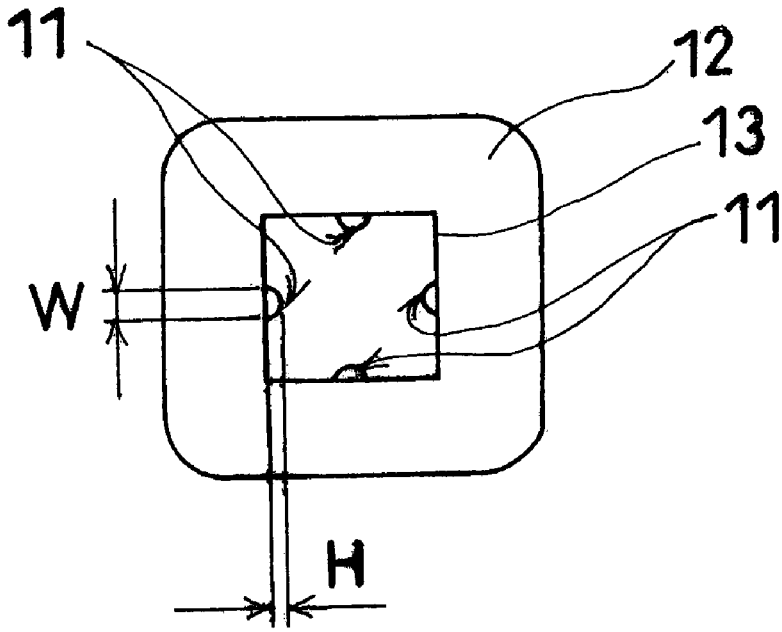
FIG. 2B is a top plan view of the coil bobbin of FIG. 1.
Figure 4:
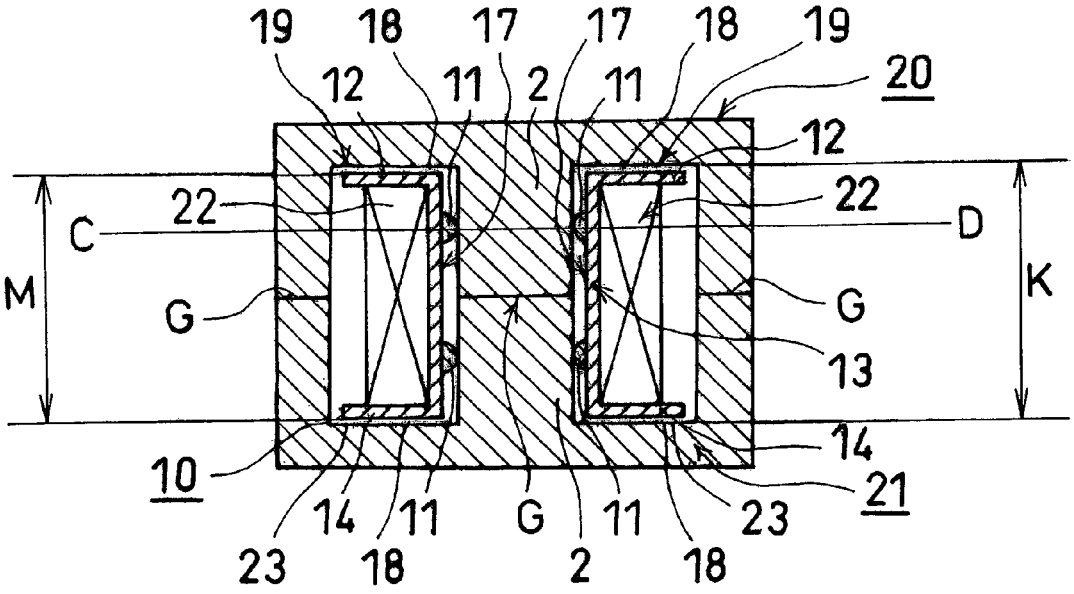
FIG. 4 is a cross-sectional view of the coil bobbin of FIG. 3 with a magnetic core inserted therein.

Referring now to FIGS. 2A and 2B, each of the core spacing mechanisms 11 has a length L smaller than a length M of the core housing portion 13, which is defined by the distance from the outside of the top flange 12 to the outside of the base flange 14. Also, as described later with reference to FIG. 4, the length M of the core housing portion 13 is smaller than the length of the portion of the magnetic core (not shown in FIGS. 2A and 2B) to be inserted into the core housing portion 13. Also, the core spacing mechanism 11 has a height H equal to or greater than 0.02 mm, which is a minimum dimension effective in preventing the inserted magnetic core portion from getting firmly fixed by varnish. The core spacing mechanism 11 having its height H increased works more effectively. However, if the height H is increased, the cross-sectional area of the magnetic core portion to be inserted is inevitably decreased, prohibiting increase of inductance. Therefore, the height H is set at 1 mm maximum. Also, the core spacing mechanism 11 has its width W varying according to the shape of its portion with which the magnetic core is in contact. For example, if the ridge of the core spacing mechanism 11 is shaped semicircular in cross section, the width W is determined by its curvature.

Figure 3:
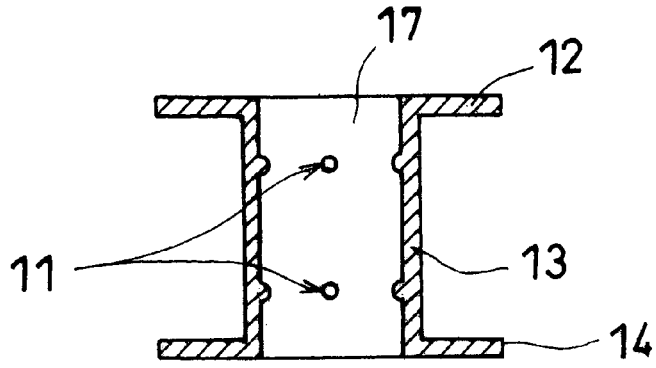
FIG. 3 is a cross-sectional view (taken in the same manner as FIG. 2A) of a coil bobbin according to a second embodiment of the present invention.
Figure 5:
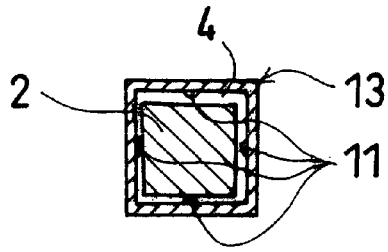
FIG. 5 is a cross-sectional view of the coil bobbin and the magnetic core (a middle bar of an E core section) of FIG. 4 taken along a line C-D.
Figure 6A:
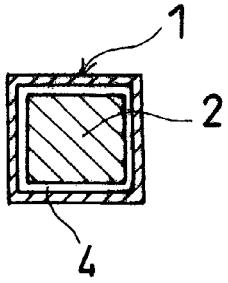
Figure 6B:
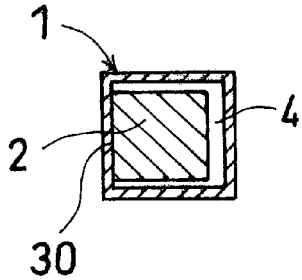
Figure 6C:
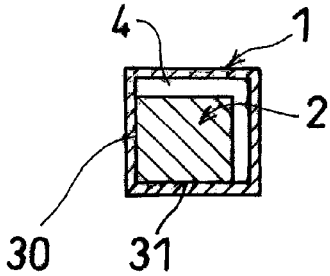

The core spacing mechanism 11 does not have to be formed into a linear ridge as described above, but may alternatively, for example, consist of two dot projections formed on each of the four surfaces of the inner wall 17 of the core housing portion 13 as shown in FIG. 3. If the magnetic core consists of two separate core sections abutting against each other, like EE type, and UU type, the two dot projections constituting the core spacing mechanism 11 are located so as to sandwich the abutting contact surface plane. For example, referring to FIG. 4, an EE type magnetic core 50 consists of two E cores 20 and 21, which abut against each other constituting an abutting contact surface G. The coil bobbin 10 has a magnet wire 22 wound therearound, and respective middle bars 2, and 2 of the E cores 20 and 21 are inserted in the core housing portion 13. Each of the inner wall surfaces 17 of the core housing portion 13 is provided with the core spacing mechanism 11, as shown in FIG. 5, which consists of the two dot projections located so as to sandwich the plane of the abutting contact surface G. Consequently, each of side surfaces of the middle bars 2, 2 is prevented by one of the dot projections from coming in contact with the inner wall surface 17 and is kept apart therefrom by a dimension equal to the height H shown in FIG. 2B.

Figure 7A:
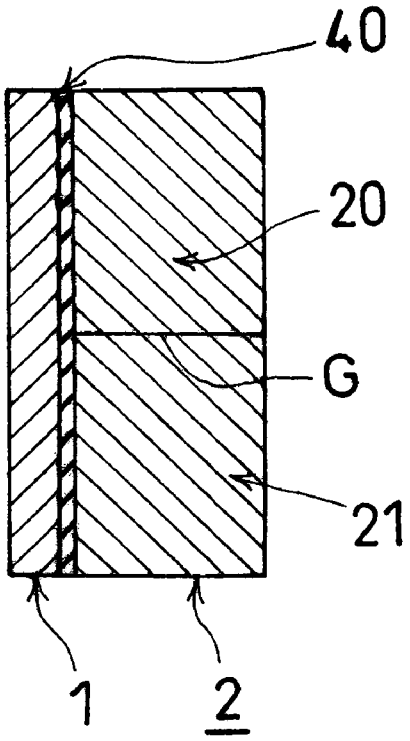
Figure 7B:
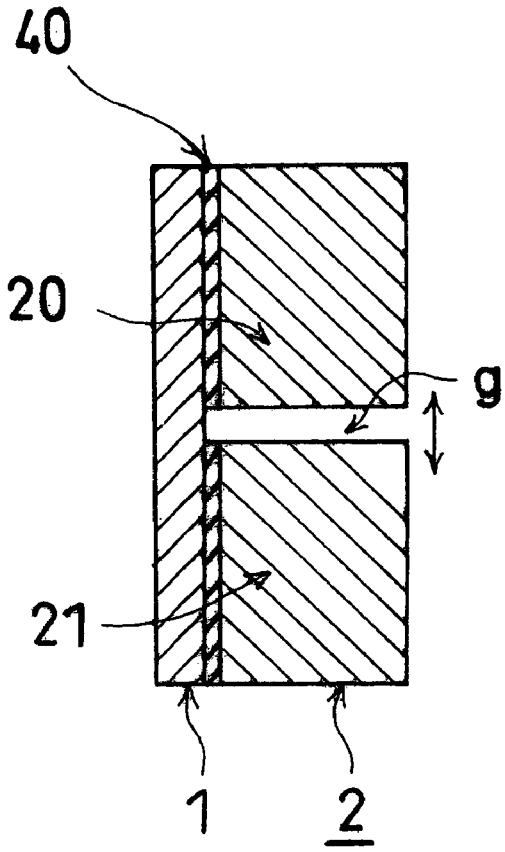

A length K, which is equivalent to a sum of lengths of the two middle bars 2 and 2, is greater than the length M of the core housing portion 13, that is the distance between the outside of the top flange 12 and the outside of the base flange 14. Thus, predetermined clearances 18 are provided so that the top flange 12 and the base flange 14 do not come into contact with inner surfaces 19 and 23 of the E cores 20 and 21 respectively, even when the coil bobbin 10 is expanded. Therefore, the top flange 12 and the base flange 14 do not press against the inner surfaces 19 and 23 thus preventing separation of the two E cores 20 and 21 from each other, consequently preventing generation of the gap g shown in FIG. 7B.

What is claimed is:

1. A coil bobbin comprising:

a core housing portion which has a magnet wire wound therearound, undergoes a varnish impregnation treatment together with a magnetic core that includes two core sections, and which has core spacing mechanisms formed on inner surfaces thereof, said core spacing mechanisms making contact with said magnetic core thereby generating spaces between said inner surfaces of said core housing portion and said magnetic core so as to control a position of said magnetic core.

2. A coil bobbin as claimed in claim 1, wherein said core spacing mechanisms each consist of a linear ridge.

3. A coil bobbin as claimed in claim 1, wherein said core spacing mechanisms each consist of two separate dot projections.

4. A coil bobbin as claimed in claim 1, wherein each of said spacing mechanisms is formed symmetrically about a plane of a abutting contact surface defined between said two core sections of said magnetic core.

5. A coil bobbin as claimed in claim 4, wherein said core spacing mechanisms each consist of a linear ridge.

6. A coil bobbin as claimed in claim 4, wherein said core spacing mechanisms each consist of two separate dot projections.

7. A coil bobbin as claimed in claim 1, wherein at least one core spacing mechanism is formed on each of inner wall surfaces of said core housing portion.

8. A coil bobbin as claimed in claim 7, wherein each of said spacing mechanisms is formed symmetrically about a plane of a abutting contact surface defined between said two core sections of said magnetic core.

9. A coil bobbin as claimed in claim 7, wherein said core spacing mechanisms each consist of two separate dot projections.

10. A coil bobbin as claimed in claim 7, wherein said core spacing mechanisms each consist of a linear ridge.

* * * * *